United States Patent [19]

Montague

[11] 4,262,811

[45] Apr. 21, 1981

[54] LOG CARRIER

[76] Inventor: Marvin Montague, Box 122, Clark Fork, Id. 83811

[21] Appl. No.: 89,502

[22] Filed: Oct. 30, 1979

[51] Int. Cl.[3] ..... B66C 21/00

[52] U.S. Cl. ..... 212/87; 212/110; 212/122

[58] Field of Search ..... 212/87, 92, 93, 110, 212/117–119, 122, 94, 96, 98, 106, 108, 116; 104/112, 113, 173 R, 183

[56] References Cited

U.S. PATENT DOCUMENTS

| | | | |
|---|---|---|---|
| 2,790,561 | 4/1957 | Wyssen | 212/122 |
| 3,079,008 | 2/1963 | Naud | 212/94 |
| 3,863,774 | 2/1975 | Brandt | 212/122 |
| 3,889,819 | 6/1975 | Koller | 212/122 |

FOREIGN PATENT DOCUMENTS

| | | | |
|---|---|---|---|
| 179555 | 9/1954 | Austria | 212/87 |
| 40106 | 10/1911 | Sweden | 212/110 |

*Primary Examiner*—Joseph E. Valenza

*Attorney, Agent, or Firm*—Wells, St. John & Roberts

[57] ABSTRACT

A carriage is described for utilization along a highline for the purpose of guiding a mainline along the highline between a yarder at a landing and an anchor point along an adjacent hillside. The carriage is suspended by free-wheeling sheaves on the skyline. The mainline also extends through the carriage. A highline clamp and mainline clamp are provided within the carriage and are actuated to clamp and release the highline and mainline relative to the carriage frame. Actuation is accomplished through the mainline winch at the yarder by producing tension along the mainline and by moving an abutment on the mainline against the actuator.

18 Claims, 7 Drawing Figures

LOG CARRIER

BACKGROUND OF THE INVENTION

The present invention is related to logging carriages and more particularly to such carriages used in conjunction with highline type logging for the purpose of skidding logs from a hillside to a landing.

"Highline" or "skyline" type logging is used primarily in steep forested country where conventional wheel or track type skidders cannot be effectively utilized. In this type of logging operation, a landing or flat area is located along a roadbed adjacent the area to be logged. A "yarder" (a specially built crane with two or more fairload lines and winch arrangements) is positioned at the landing. The "highline" extends from the top fairlead of the yarder up or down the hillside to an anchor point. A carriage is then movably mounted to the highline to carry a "mainline" up or down the hillside. Cut logs are gathered on choker cables at the free end of the mainline and are pulled to the carriage by the mainline winch.

The typical carriage includes some form of internal mechanism that alternately clamps the carriage to either the skyline or the mainline. The mechanism is used to clamp the carriage to the mainline while it is moving along the skyline from the yarder along the hillside toward the anchor point and back along the hillside with a "turn" of logs. As the carriage reaches a desired destination, it becomes desirable to release the mainline and clamp the carriage to the highline. This is typically accomplished by some form of actuator mechanism on the highline, set at a location adjacent the cut logs. The actuator causes an internal mechanism to grip the skyline, halting further progress of the carriage, and to release the mainline. The mainline can then be pulled from the carriage to the cut logs where the chokers can be connected. The mainline winch is then operated to pull the mainline back through the carriage and toward the yarder. This brings the log or logs through the carriage, which is clamped in a stationary position on the skyline.

As the log or logs arrive at the carriage, an actuator along the mainline trips the mechanism, releasing the highline clamps and, in some apparatus, sets a clamp against the mainline. The log or logs are then pulled over the hillside to the landing.

The highline is lowered with the mainline being held taut in order to lower the entire carriage and logs to the ground surface. The logs are then disconnected from the mainline and the highline is retightened to allow movement of the carriage along the hillside for the next successive load.

The difficulty with known forms of highline log carriages, is that the actuator along the highline must be manually placed along the length of the highline for the purpose of halting further progression of the carriage. This can be a difficult and hazardous duty, especially when the highline is suspended high above the ground. Furthermore, the abrupt shock of the carriage hitting the actuator produces severe strain on the highline causing premature wear and frequent breakage.

An additional problem is encountered at the landing, where the highline must be lowered in order to deliver the logs from the mainline, since there is no known form of actuator that may be situated adjacent the yarder along the highline for the purpose of releasing the mainline clamp and allowing the log or logs to drop onto the landing. Instead, the highline must be again handled to lower the carriage onto the landing. It is not desirable to continually change the tension and elevation of the highline during operation. It can easily become tangled in trees or undergrowth at any point along its length, requiring valuable time to untangle and free the highline for the next journey of the carriage over the hillside.

U.S. Pat. No. 1,543,473 to G. J. Fayette discloses a skyline logging carriage lock assembly operating on the same basic principles as described above. An abutment is situated along the skyline for the purpose of tripping a locking mechanism which releases the mainline.

The E. O Naud U.S. Pat. No. 3,079,008 discloses an electronically operated hoisting and conveying apparatus. The apparatus is basically a highline type logging carriage having a number of "radio controlled" braking mechanisms utilized for the purpose of halting progress of the carriage along the hillside and for clamping and releasing a mainline.

The M. J. McIntyre U.S. Pat. No. 3,083,839 discloses a cable logging operation that also makes use of radio control devices for actuating highline and mainline braking apparatus.

U.S. Pat. No. 2,649,209 to J. S. Wilson discloses a movable skyline terminal having actuators at opposite ends of a skyline that serve to cause alternate releasing and locking of the mainline. A ball on the mainline serves as a locking member against which a locking mechanism operates.

U.S. Pat. No. 3,948,398 to Donald D. Christensen discloses a self-locking logging skidding carriage with a simplified form of the skyline actuator mechanism. The actuator on the skyline serves to release the mainline at a selected position on the skyline, allowing it to be pulled out and connected to a turn of logs. Retraction of the mainline moves an actuator ball into engagement with the mechanism, causing it to unlock the skyline actuator and lock against the mainline to allow the mainline winch to pull the carriage and turn of logs along the hillside to the landing.

U.S. Pat. No. 1,509,716 to William G. Daniel is directed to a log carrier that utilizes several lines beyond the usual highline and mainline. Daniel supports his carriage on a single skyline but has several major and minor lines arranged on various pulleys for the purpose of pulling logs to the carriage, moving the carriage along the highline, and playing out the main, log engaging lines. The primary or major pull cable is extended, once the carriage is moved to a selected position, by drawing a secondary line over a pulley. The pulley turns and forces a second pulley to engage and rotate a grooved pulley that receives the primary pull cable. Taking up the secondary pulling line will cause the primary line to be drawn out from the carriage and allow attachment of logs to the free end thereof. Subsequently, retraction of the primary cable will pull the logs to the carriage. The carriage can then be moved along the highline to a landing.

Of the above patents and of all prior carriages known to the invention, none make use of a carriage operated solely from the mainline that include the functions of simultaneously gripping one line and releasing the other in response to engagement of an abutment on the mainline and in response to tension applied along the mainline.

DETAILED DESCRIPTION OF A PREFERRED EMBODIMENT

Figure 3:
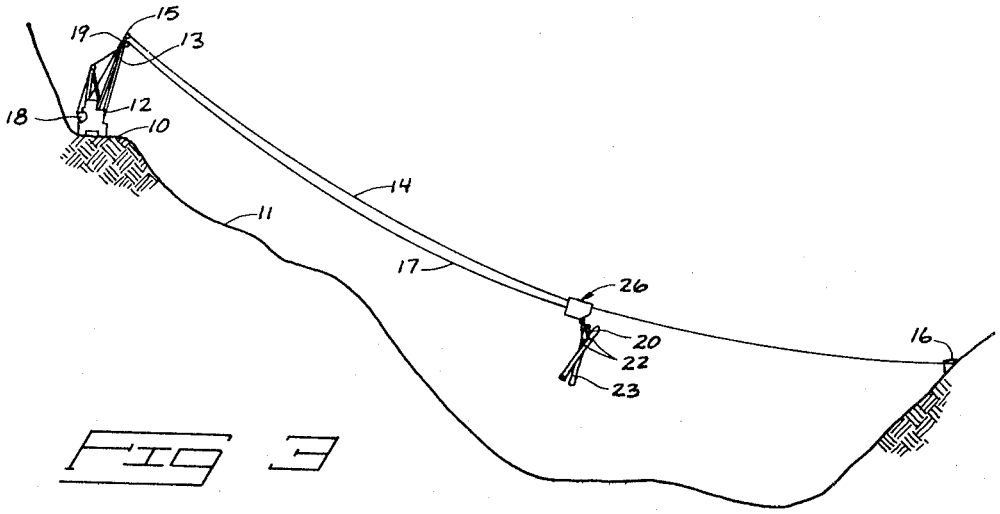
FIG. 3 is a diagrammatic view illustrating operation of the present carriage.

The present invention is intended for use in conjunction with highline or skyline type logging operations, a diagrammatic example of which is shown in FIG. 3. In such operations, it is common to make use of a flat landing 10 along a hillside 11 leading from the landing. A yarder 12 is stationed at the landing having an upright boom 13. A highline 14 extends from an upper fairlead 15 on the boom to an anchor point 16 along the hillside from the landing. The anchor point 16 may be spaced a substantial distance from the landing depending upon the terrain and capacity of the yarder. The anchor point 16 for the highline 14 is often a large tree that securely anchors the skyline at an above ground position. The highline 14 is played out and taken up on a winch drum (not shown) provided as a conventional element of the yarder 12. It is preferred to extend the highline, attach it to the anchor point and draw the line taut between the fairlead 15 and anchor point 16.

Logs are gathered to the yarder through operation of a mainline 17. The mainline 17 extends from a mainline winch drum 18 on the yarder 12 over a fairlead 19 below the highline fairlead 15. A free end 20 of the mainline 17 may include an abutment 21 (FIG. 1) such as one or several choker bells or other form of log attaching mechanism. Chokers 22 are mounted to the free mainline end for the purpose of gathering one or more logs together in a "turn" 23.

The mainline 17 is carried along the length of the highline by means of a carriage 26. It is such a carriage 26 that is disclosed herein and claimed as the present invention.

Figure 1:
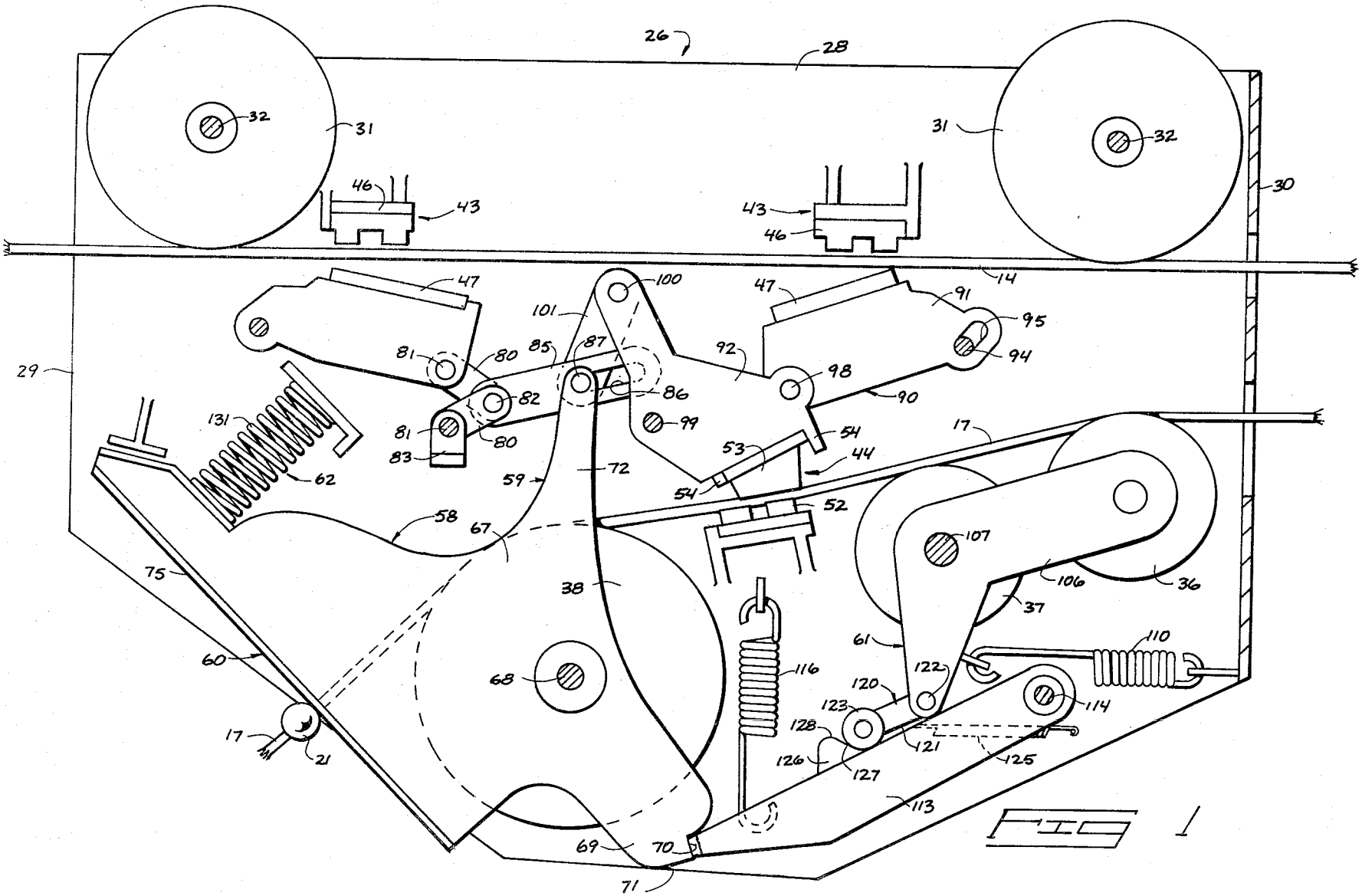
FIG. 1 is a cross-sectional side elevational view through the present carriage.
Figure 2:
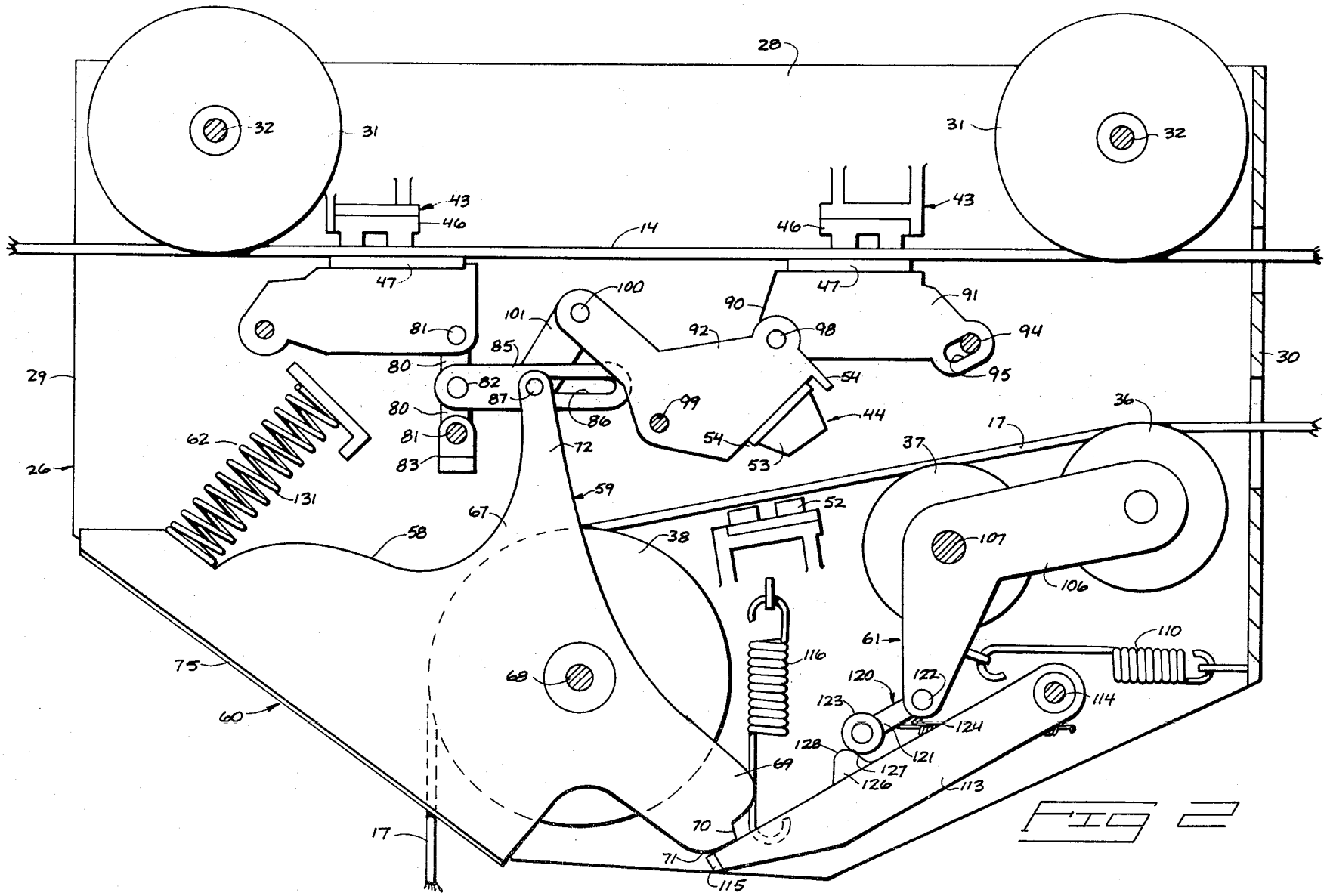
FIG. 2 is a view similar to FIG. 1 only showing a different operational position of the elements therein.

The present carriage 26 is generally shown in FIG. 3 and is shown in much more detail by FIGS. 1 and 2. The carriage basically is comprised of a somewhat closed frame 28 having a front end 29 facing the anchor point and a rearward end 30 facing the yarder 12. The frame is movably supported on the highline by highline sheaves 31. The sheaves 31 are freely rotated on the frame and spaced apart at the ends of the frame to support the entire carriage for relatively free movement on the highline. The highline sheaves 31 are rotatably carried by pins 32 that, in turn, are fixed to the frame 28.

The mainline 17 is also carried through the frame 28 and is guided through by three longitudinally spaced sheaves. A first sheave 36 of the three is positioned to "float" at a rearward end of a bellcrank mechanism (to be described later). The second sheave 37 is situated at a pivot point for the bellcrank mechanism and the third sheave 38 is situated rearwardly of the first two for free rotational movement about the axis of a lever means (also described below). The three sheaves 36 through 38 are all freely rotatable to guide movement of the mainline through the frame.

Within the carriage frame 28 are a plurality of working elements that enable selective operation thereof from the yarder 12 without using any form of abutment surface along the length of the highline 14.

Within the carriage frame 28 is a highline clamp means 43 and a mainline clamp means 44. Clamp means 43 and 44 operate respectively to clamp and release the frame to the highline and mainline. Operation of both clamp means 43 and 44 is substantially simultaneous, with one opening while the other closes. Therefore, FIG. 2 shows a first clamp position with the highline clamp means 43 in a closed position and with the mainline clamp means 44 open. FIG. 1 shows second clamp positions, with the highline clamp means 43 opened while the mainline clamp means is closed. It can therefore be understood that the carriage will be held stationary on the highline while the mainline cable may be played out or withdrawn back onto the mainline winch drum. The carriage therefore may become a solid anchor point to which the turn of logs is drawn after the chokers have been set. Clamping of the mainline to the carriage assures that no excessive stress will be placed on the mainline abutment 21 as the carriage and turn of logs is being pulled up the hill.

The highline clamp means 43 includes two spaced pairs of brake assemblies, one adjacent each of the highline engaging sheaves 31. Each pair includes a stationary brake pad 46 and a movable brake pad 47. The stationary pads 46 are fixed to the frame above the highline 14. The movable pads 47 are situated below and pivot about horizontal pivot axes. All pads 46 and 47 are removable for replacement after eventual wear.

The mainline clamp means 42 includes a stationary brake pad 52 and movable brake pad 53. Brake pad 53 is slidable on its mount between stop surfaces 54. The surfaces 54 allow longitudinal movement of the pad in response to similar movement of the engaged mainline when the clamp means 44 is in the closed, FIG. 1 condition. Sliding movement of the brake pad 53 between the stops allows operation of an actuator means 58.

The actuator means 58 is selectively operable through the mainline winch 18 to cause operation of the mainline and highline clamp means. More specifically, the actuator means is utilized to: (a) cause the highline clamp means to securely clamp the highline to the carriage frame while substantially simultaneously causing the mainline clamp means to release the mainline; and (b) cause the mainline clamp means to clamp the mainline while causing the highline clamp means to release the highline, all in response to tension applied to the mainline and to forceable movement of the abutment 21 toward the yarder 12.

The actuator means 58 includes four basic subassemblies. First is a lever means 59 which pivots within the carriage frame for operating the highline and mainline clamp means. An operator means 60 is associated with the lever means and causes motion of the lever means about its pivot axis in response to engagement with the mainline abutment 21. A latch means 61 is operably connected between the mainline and lever means 59 to selectively lock and unlock the lever means (and the clamp means 43 and 44) in response to tension applied along the mainline. Finally, biasing means 62 is also provided as part of the actuator means 58 for normally urging the lever means 59 toward the FIG. 2 position.

FIGS. 1 and 2 show the lever means 59 in substantial detail. It is basically comprised of a plate 67 sandwiched between sides of the carriage frame. The plate 67 is pivoted at 68 about the axis of the mainline sheave 38.

Figure 6:
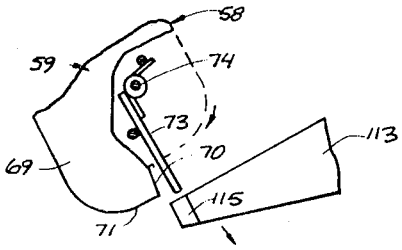
FIG. 6 is a view similar to FIG. 5 only showing a different operational position of the elements therein.
Figure 5:
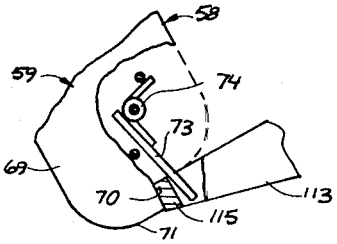
FIG. 5 is an enlarged fragmentary view illustrating a lockout mechanism.
Figure 7:
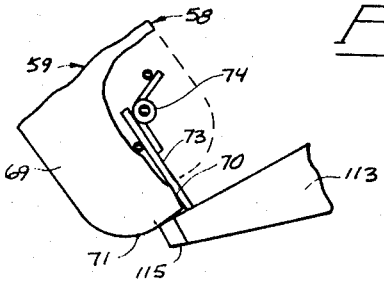
FIG. 7 is a view similar to FIGS. 5 and 6 showing another operational position of the elements.

The plate 67 includes various protrusions that extend radially outward from the axis at pivot 68. One of these is a rocker arm 69. The arm 69 extends below and rearwardly to an end where a catch or notch 70 is formed. FIGS. 5 through 7 illustrate a lockout plate 73 mounted to the plate 67 adjacent the catch 70. The lockout 73 is urged by a torsion spring 74 toward a lockout position as shown in FIG. 6. However, the spring 74 will allow pivotal movement of plate 73 in the direction indicated by FIG. 5. A smooth cam surface 71 is situated adjacent to the catch 70.

The operator means 60 is simply comprised of a face plate 75 extending along one side of the plate 67. The face plate 75 straddles the mainline 17 and is positioned in relation thereto for direct engagement by the abutment 21. The face plate 75 extends along the plate to one side thereof opposite the rocker arm and catch. The face plate 75, when forceably engaged by the abutment 21, will cause pivotal movement of the entire lever means 59 about the pivot 68. It is this pivot movement of the lever means 59 that causes corresponding movement of the highline and mainline clamp means as they open and close.

Motion of the lever means 59 is transmitted to the highline and mainline clamp means by a pair of toggle linkages shown in FIGS. 1 and 2. A front toggle mechanism is comprised of two matched toggle links 80 joined by pins 81 at outer ends and a pin 82 at their joined inward ends. One of the outer pins 81 is anchored by bracket 83 to the carraige frame. The remaining pin 81 is mounted to a pivoted bracket 84 holding the forward movable brake pad 47.

The toggle links 80 are shifted from the dead center position of FIG. 2 to the collapsed, off-dead center position of FIG. 1 by an actuator rod 85 connected by a pin 87 to an upright arm 72 of lever means 59. The pin 87 rides within an elongated slot 86 which provides a lost motion feature allowing travel of the lever means 59 before the toggle links 80 are moved to break the dead center position.

The rearward toggle mechanism is shown at 90 adjacent the rearward highline sheave. The rearward toggle is connected to the lever means 59 through the same pin 87 at the upper end of arm 72. The rearward toggle differs substantially from the forward toggle in that it also mounts the movable brake pad for the mainline clamp means. It may therefore be considered a "double toggle" arrangement with one locked, dead center position shown in FIG. 2 and a second locked dead center position shown in FIG. 1.

The upper link 91 of the toggle 90 is comprised of the bracket that mounts the movable pad 47 for the forward highline clamp. The remaining link of the rearward toggle is indicated at 92. The upper link 91 is pivotably mounted to the carriage frame by a pin 94 that is loosely received within an angular slot 95. The slot 95, like slot 86, provides a lost motion feature, allowing slight movement of the toggle in response to the lever means 59. The upper link 91 and lower link 92 are pivotably connected by a pin 98. Another pin 99 connects the lower link to the carriage frame. Pin 99 defines the pivot axis for the lower link on the frame. Opposite the pin 98 is another pin 100 which interconnects the lower link with the lever means 59. The pin 100 mounts the link 92 to a connecting link 101 that extends from pin 100 to the upstanding lever arm 72. There it is pivotably mounted to the pin 87 of the upright arm 72.

The "double toggle" arrangement of the rear toggle can best be understood with reference to FIGS. 1 and 2. In FIG. 1, the toggle has been shifted to close the brake pads of the rearward highline clamp. In this position, the pins 94, 98 and 100 are substantially aligned in a dead center orientation. The dead center relationship is broken as the lever means is shifted rearwardly. Pin 98 is shifted downwardly as the mainline clamp means is closed on the mainline. As the clamp closes, a new dead center relationship becomes apparent along a line from pin 94 through pins 98 and 99. Thus, the "double toggle" arrangement.

Figure 4:
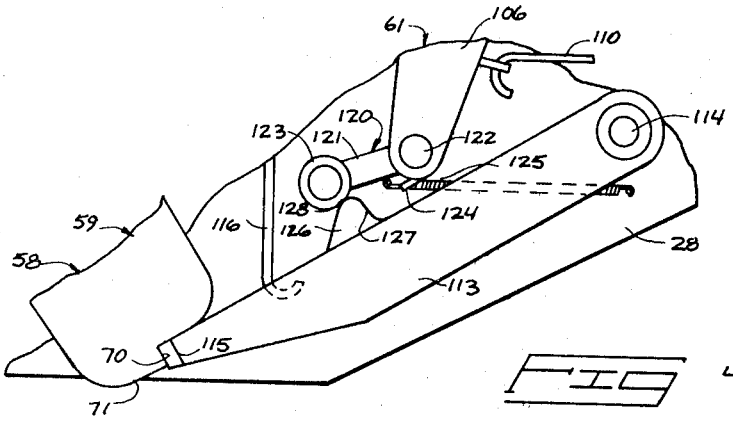
FIG. 4 is a fragmentary view illustrating a further position of elements shown in FIGS. 1 and 2.

The latch means 61 is shown in its several operational positions in FIGS. 1, 2 and 4. It includes an "L" shaped bellcrank 106 that mounts the roller 36 at its outward end and roller 37 at its central pivot 107. The roller 36 is situated at an outboard rearward end of the bellcrank and rotatably engages the mainline. The bellcrank is urged toward the position shown in FIG. 1 by a spring means 110 operating on an end of the bellcrank opposite the rearward end. Therefore, the bellcrank will pivot about the axis of pivot 107, only against resistance of the spring 110. Such pivotal movement may be caused by applying tension along the length of the mainline. For example, if sufficient tension is applied along the mainline, the bellcrank will be pivoted in a clockwise direction from the FIG. 1 position to the FIG. 2 or FIG. 4 positions. It may thus be seen that tension applied along the mainline can be effectively utilized for the purpose of operating the latch mechanism.

Below the bellcrank 106 is a lever engaging bolt member 113. It is pivotably mounted to the frame by a pin 114. The free end of the bolt member 113 is shown at 115. The end 115 is provided for selective engagement within the catch 70 of rocker arm 69 or for sliding over the cam surface 71. FIGS. 1 and 4 show the end 115 engaging the notch 70 while FIGS. 2, 6 and 7 show the notch and bolt end 115 disengaged. FIGS. 2 and 7 show the end 115 riding over the cam surface 71.

The lever engaging bolt member 113 is normally urged toward engagement with the notch 70 or against the cam surface 71 by a tension spring 116. The spring is mounted between the frame and bolt member 113 to resist downward movement of the bolt member away from the rocker arm end notch.

A link means 120 functions as an intermittent motion transmitting means, operatively connecting the lever engaging bolt member 113 and bellcrank 106 for the purpose of selectively transmitting motion of the bellcrank to the bolt member. The link means includes a short link arm 121 mounted by a pivot pin 122 at the free end of the bellcrank 106. A roller 123 is mounted at the free end of the link arm 121. Roller 123 and link arm 121 are pivoted on the bellcrank to an angular position as shown in FIGS. 1 and 2 against a stop 124 (FIG. 4) provided on the bellcrank. The link arm and roller are urged against the stop 124 by a spring 125. Otherwise, the link arm and roller will pivot up and downwardly about the pivot 122 against resistance of spring 125. Of course, the link arm 122 and roller 123 will pivot simultaneously with pivotal movement of the bellcrank 106.

The roller 123 is held in engagement with a cam 126 that is rigidly fixed to the lever engaging bolt member 113. The roller may move over an incline surface 127 of the cam 124. This occurs as the bellcrank is being pivoted downwardly due to tension being applied along the mainline. The stop 124 will not allow downward pivotal movement of the short link arm 121. The only recourse, then, is for the bolt member 113 to pivot downwardly as the roller 123 moves over the inclined surface 127. This movement results in disengagement of the bolt member end 115 from the catch 70.

An upper surface of the cam 126 is rounded at 128 to facilitate relatively free motion of the roller 123 thereon. The surface 128 is positioned so the roller 123 and link arm 121 will snap over the surface and roll relatively freely thereon (FIG. 4) in response to downward movement of the bellcrank beyond a prescribed position. The roller and the link at that point will not cause further movement to the bolt member 113 due to any increased tension along the mainline.

FIGS. 2 and 5 through 7 illustrate what happens when the lever engaging bolt member 113 is moved to disengage its end 115 from catch 70. As shown, the release results in forced pivotal movement of the lever means in a counterclockwise direction. As this happens, the mainline and highline clamps are operated by the described toggle mechanisms to close on the mainline and release the highline.

The counterclockwise motion of the lever means is caused by the biasing means 62 which is simply comprised of a compression spring 131 mounted between the frame and lever means 59. The spring constantly urges the lever means to move the highline clamp means and the mainline clamp means toward the FIG. 2 position. It does so as the bolt end 115 is disengaged by operation of the latch means (due to tension along the mainline). The previously compressed spring 131 is then allowed to expand against the lever means, moving it from the FIG. 1 position to the FIG. 2 position.

From the above technical description, operation of the present invention may now be understood.

Prior to its use, the present carriage is mounted to the highline simply by threading a free end of the highline through the carriage beneath the highline sheaves and through the highline clamp means. The mainline is similarly threaded through the carriage over the three mainline sheaves and through the mainline clamp means.

The free end of the mainline is then drawn along a hillside from the landing to the anchor point where it is fastened at an above ground location so that the remainder of the highline is suspended between the anchor point and the yarder. FIG. 3 shows an arrangement with the anchor point being located at a downhill position. It is understood, however, that the present carriage can also be used, with slight modification, in rigging an uphill logging arrangement.

The carriage is initially situated adjacent to the boom of the yarder with the mainline drawn onto the mainline winch so that the abutment 21 is against the face plate and the clamp means are situated in the FIG. 1 position. The mainline winch can then be used to lower the carriage by gravity down the hill. The carriage will roll along freely over the highline and, due to its weight, will pull the mainline from the mainline winch drum.

The operator can stop downward progress of the carriage at any point along the length of the mainline simply by tightening the brake on the mainline winch drum. As the drum brake tightens, the mainline becomes taut between the drum and the relatively heavy carriage. The taut mainline causes the bellcrank to pivot downwardly. As this happens, the link arm 121 and roller 123 operate against the lever engaging bolt member 113, causing it to pivot downwardly disengaging its end 115 from the notch 70. As the lever end disengages notch 70, the lockout plate 73 snaps into position (FIG. 6) preventing the end 115 from snapping back into engagement with the notch. The end 115 is then free to slide over the cam surface 71.

As tension builds along the mainline, the bellcrank will pivot on downwardly. Such continued motion brings the link arm 121 and roller 123 upwardly over the cam to engage the arcuate top surface 128. There, the roller will quickly move to the opposite side of the inclined cam surface 127 as shown in FIG. 4. The roller 123 and link arm 121 then have no solid surface to push against and can not cause further pivotal movement of the bolt member 113 in response to downward movement of the bellcrank.

When the carriage stops, tension along the mainline decreases as downhill momentum of the carriage is reduced. Therefore, as all forward motion of the carriage halts, the spring 131 of biasing means 62 will overcome the resistance of tension along the mainline and allow the lever means to pivot, releasing the mainline clamp means and applying the highline clamp means. This movement is also allowed by a slight forward sliding movement of the brake pad 53 on the mainline brake means. The forward longitudinal sliding motion of the pad allows sufficient movement of the lever means to break the dead center relationship of the rearward toggle formed by pins 94 or 98 and 99 (FIG. 1). The motion also allows the mainline clamp to snap open and the highline clamp means to snap shut, releasing the mainline and securely clamping the highline to the frame.

The carriage is then anchored by the highline clamp means to the highline. The mainline clamp means is open. The entire carriage appears substantially as it does in FIG. 2 with the exception that the roller 123 in that position would be situated along the arcuate top surface 128 of the cam 126. The mainline is then free to be drawn out through the carriage to a "turn" of cut logs situated about the area of the carriage. The chokers are set about the logs and the yarder operator is signalled.

Upon receiving the signal, the yarder operator will actuate the mainline winch, drawing the mainline inwardly through the carriage. The highline clamp means will hold the carriage securely on the highline as the turn of logs is pulled along the ground and finally lifted upwardly toward the forward end of the carriage.

The highline clamp means is released and the mainline clamp means is applied as the abutment 21 on the mainline comes into engagement with the operator means 60 (face plate 75). Continued uphill motion of the abutment against the face plate causes the lever means to pivot from the FIG. 2 position toward the FIG. 1 position. The toggle mechanisms are operated by the lever means to open the highline clamp means and close the mainline clamp means.

Tension along the cable increases progressively as the load against the carriage of the logs increases. It therefore follows that the bellcrank 106 will be held in a downwardly pivoted position. The intermittent motion provision of the roller and link arm arrangement, however, prevents transmittal of the bellcrank movement to the bolt member 113 as this occurs. The roller will simply move over the top arcuate surface 128 of the cam 126 during this stage.

The bolt end 115 will again snap into engagement with the notch 70 as the lever means is pivoted back to the FIG. 1 position. However, the roller 123 and link arm 121 will remain in the inoperative position shown in FIG. 4 due to tension along the mainline. The FIG. 4 position will be maintained during movement of the logs to the carriage and during movement of the carriage and turn of logs along the hillside to the landing.

The mainline winch is used to pull the carriage and logs up the hill with the mainline clamp holding the mainline secure to the carriage. The slidable brake pad 53 of the mainline clamp means is not allowed to move in the direction of the yarder so the clamping action of the mainline is secure.

The turn of logs is released at the landing as the operator first allows the mainline to go slack. This enables upward pivotal movement of the bellcrank due to the tension of spring means 110. This produces corresponding movement of the roller 123 and link arm 121 over the cam 126 to the FIG. 1 position. The latch means is thereby reset to function in response to tension along the cable to move the bolt member 113 from engagement with catch 70. This is done by reapplying tension to the mainline. In response, the bellcrank will pivot downwardly. This movement forces the roller against the cam to pivot the bolt member 113 from engagement with the catch. The lockout plate will prevent movement of the bolt member end 115 back into the notch. The mainline can be slackened again to allow pivotal movement of the lever means. The pivoting lever means causes the highline clamp means to close and the mainline clamp to open. The released mainline can then be lowered to the ground and the slack chokers can be removed from the turn of logs.

Once the turn of logs has been released, the mainline can be drawn again to the carriage. The abutment will again engage the face plate and pivot the lever back to the position where the bolt end 115 will snap again into the catch 70. The highline clamps will then open and the mainline clamp closes, returning the carriage to the FIG. 1 condition.

The slack mainline, prior to this time, has allowed the bellcrank to swing back up, repositioning the roller 123 and link arm 121 to the FIG. 1 position. The carriage is then ready for another operational cycle.

It is to be noted that the above description and attached drawings are given by way of example and that other forms of the device and mechanisms disclosed therein may be derived therefrom. The scope of my invention is therefore more closely defined in the attached claims.

What I claim is:

1. A log skidding carriage for operation on a highline and mainline of a yarder with the mainline having an abutment at a free end thereof; comprising:

a carriage frame;

highline sheave means on the frame adapted to movably suspend the carriage frame from the highline;

mainline sheave means on the frame adapted to movably receive and guide the mainline through the carriage frame;

highline clamp means on the frame for selectively moving between a first position clamping the highline securely to the frame and a second position free of the highline;

mainline clamp means on the frame for selectively moving between a first position free of the mainline and a second position clamping the mainline securely to the frame;

lever means for simultaneously moving the highline and mainline clamp means between their respective first and second positions;

biasing means urging the lever means to move the mainline and highline clamping means to their respective first positions;

operator means responsive to forcible engagement of the lever means by the abutment on the mainline for causing the lever means to move the mainline and highline clamp means to their respective second positions; and latch means operably connecting the mainline and lever means and selectively responsive to tension applied to te mainline for: (a) locking the mainline and highline clamp means in their respective second positions, and (b) unlocking the mainline and highline clamp means to allow the biasing means to cause movement of the mainline and highline clamp means to their respective first positions.

2. The log skidding carriage as defined in claim 1 wherein the lever means includes a catch and wherein the latch means includes:

a bellcrank pivotably mounted to the frame having one end thereof adapted to engage the mainline and pivot in one direction as the mainline is drawn taut and to pivot in an opposite direction when the mainline is slack;

a lever engaging bolt member releasably engaging the catch;

a spring connecting the lever engaging bolt member and frame for urging the bolt member toward the catch;

link means between the lever engaging bolt member and the bellcrank, responsive to movement of the bellcrank to selectively allow movement of the lever engaging bolt member relative to the catch and to operate against the spring to move the bolt member away from the catch.

3. The carriage as defined by claim 2 wherein the link means includes an intermittent motion transfer means responsive to selected tension along the mainline to release the bellcrank for pivotal movement relative to the lever engaging bolt member.

4. The log skidding carriage as defined in claim 2 wherein the lever means includes a rocker arm pivoted to the frame at the axis of the mainline sheave.

5. The log skidding carriage as defined by claim 4 wherein the catch is formed within the rocker arm;

and wherein the lever engaging bolt member pivoted on the frame end is spring loaded to snap into the catch when the lever is moved to the second position.

6. The log skidding carriage as defined by claim 5 wherein the rocker arm includes an arcuate cam surface adjacent the notch for slidably the bolt member as the lever means moves between the first and second positions.

7. The log skidding carriage as defined by claim 1 wherein the highline clamp means is comprised of a pair of clamp assemblies spaced apart longitudinally on the frame in relation to the mainline.

8. The log skidding carriage as defined by claim 7 wherein the highline sheave means includes two freely rotatable sheaves mounted to the frame adjacent the highline clamp assemblies.

9. The log skidding carriage as defined by claim 1 wherein the highline and mainline clamp means each include replaceable brake pads situated on opposite sides of the highline and mainline respectively for engaging and clamping against the highline and mainline.

10. The log skidding carriage as defined by claim 9 wherein the mainline clamp means includes a stationary brake pad mounted to the frame and a movable brake pad operatively connected to the lever means; and wherein the brake pad on one of the shoes is movable between stop surfaces on the frame and is adapted to move a prescribed distance with the mainline between the stop surfaces.

11. The log skidding carriage as defined by claim 1 wherein the lever means is pivoted on the frame about a fixed axis; and wherein the operator means is comprised of a face plate on the lever means extending to one side of the pivot axis for the lever means in the path of the mainline through the frame so that when the mainline is being retracted through the frame, the abutment will enage and press against the face plate, causing the lever means to pivot about its axis.

12. A carriage for operation in highline logging along a highline extending suspended from a yarder at a landing and an anchor point along a hillside spaced from the landing for guiding a mainline from a mainline winch on the yarder, said mainline having an abutment at a free end thereof, comprising:

a carriage frame;

highline sheave means on the frame for suspending the carriage frame from the highline for free movement along the length of the highline between the yarder and anchor point;

mainline sheave means on the carriage frame for engaging and guiding the mainline through the carriage frame;

highline clamp means selectively movable to a first position clamping the highline securely to the carriage frame and to a second position releasing the highline for free movement on the carriage frame;

mainline clamp means on the frame for selectively moving between a first position free of the mainline and a second position clamping the mainline securely to the carriage frame; and actuator means selectively operable through the mainline winch to (a) cause the highline and mainline clamp means to move to their respective first positions, and to (b) cause the highline and mainline clamp means to move to their respective second positions in response to tension applied along the mainline between the carriage frame and in response to forcible movement of the abutment toward the yarder and against the actuator means.

13. The carriage as defined by claim 12 wherein the actuator means includes a lever means for moving the highline and mainline clamp means together to the first and second positions.

14. The carriage as defined by claim 13 wherein the actuator means further comprises operator means responsive to forcible engagement of the lever means by the abutment of the mainline for causing the lever means to move the mainline and highline clamp means to their respective second positions.

15. The carriage as defined by claim 14 further comprising:

latch means operably connecting the mainline and lever means and selectively responsive to tension applied to the mainline for: (a) locking the mainline and highline clamp means in their respective second positions, and (b) unlocking the mainline and highline clamp means; and biasing means for urging movement of the unlocked mainline and highline clamp means to their respective first positions.

16. The carriage as defined by claim 14 wherein the operator means includes a face plate positioned for selective engagement with the abutment means.

17. The carriage as defined by claim 12 wherein the highline clamp means and mainline clamp means are interconnected and simultaneously operated by a toggle linkage means operably connected to the actuator means.

18. The carriage as defined by claim 12 wherein the actuator means includes a lever means for simultaneously moving the highline and mainline clamp means to their respective first and second positions; and latch means on the frame selectively operable to lock the lever means in its second position.

* * * * *